US006963699B1

(12) United States Patent
Pearce

(10) Patent No.: US 6,963,699 B1
(45) Date of Patent: Nov. 8, 2005

(54) METHOD AND SYSTEM FOR PROVIDING AN OUT OF PAPER INDICATION BY A PRINTER

(75) Inventor: Jerry W. Pearce, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/859,623

(22) Filed: Jun. 3, 2004

(51) Int. Cl.[7] ..... G03G 15/00
(52) U.S. Cl. ..... 399/23; 399/16; 271/9.03
(58) Field of Search ..... 399/16, 23; 271/9.03; 358/1.11–1.15

(56) References Cited

U.S. PATENT DOCUMENTS 5,028,041 A * 7/1991 Kobayashi ..... 271/9.03
5,629,672 A 5/1997 Brown et al. ..... 340/540
5,812,901 A 9/1998 Morikawa ..... 399/19
5,894,542 A * 4/1999 Kim ..... 358/1.12
6,252,654 B1 6/2001 Kaya ..... 355/408
6,636,704 B2 * 10/2003 Weaver et al. ..... 399/23
2002/0114635 A1 8/2002 Park ..... 399/23

FOREIGN PATENT DOCUMENTS

JP 01148578 A * 6/1989 ..... B41J 13/00

* cited by examiner

*Primary Examiner*—Minh Chau
(74) *Attorney, Agent, or Firm*—Sawyer Law Group LLP

(57) ABSTRACT

Aspects for providing an out of paper indication by a printer are described. The aspects include controlling paper ejection during a print job to provide an out of paper indication with a last sheet of a paper supply in a printer. The controlling of the paper ejection further includes starting ejection of a page of the print job, determining if the page being ejected comprises the last sheet, completing ejection of the page when the page does not comprise the last sheet, and stopping ejection of the page when the page does comprise the last sheet. Additionally, the partial ejection of the last sheet is maintained until paper is added to the paper supply.

10 Claims, 2 Drawing Sheets

METHOD AND SYSTEM FOR PROVIDING AN OUT OF PAPER INDICATION BY A PRINTER

FIELD OF THE INVENTION

The present invention relates to printers, and more particularly to an out of paper indication by a printer.

BACKGROUND OF THE INVENTION

Many printers do not have a visible paper supply. The paper is stored in drawers or trays with the contents out of sight. When the last piece of paper is used, the printer stops printing, and an indicator turns on to indicate that the printer needs paper. Alternatively, a small Liquid Crystal Display (LCD) screen displays a message that paper is out. To implement such alert systems, sensors are used to detect when a resource is depleted. For instance, the paper tray would include an electrical or electromechanical sensor to detect when the paper tray is empty. The sensor, upon detecting that the resource is close to or at depletion, would signal the printer processor and the printer processor would, in response, enable the paper out indicator in the printer.

While the printer provides an indication of the out of paper condition, many people never notice that the printer has stopped and requires paper. Instead, they simply take their output and leave. Sometimes, their jobs are not complete, because the printer runs out of paper in the middle of the job. When someone finally realizes that the printer needs paper and replenishes the supply, the printer completes the previous job. What is needed is a printer that provides a more noticeable out of paper indicator that encourages users to replenish the paper supply and helps prevent a user from unknowingly walking away with an incomplete print job.

SUMMARY OF THE INVENTION

Aspects for providing an out of paper indication by a printer are described. The aspects include controlling paper ejection during a print job to provide an out of paper indication with a last sheet of a paper supply in a printer. The controlling of the paper ejection further includes starting ejection of a page of the print job, determining if the page being ejected comprises the last sheet, completing ejection of the page when the page does not comprise the last sheet, and stopping ejection of the page when the page does comprise the last sheet. Additionally, the partial ejection of the last sheet is maintained until paper is added to the paper supply.

Through the present invention, a straightforward technique provides a clear, visible indication of an out of paper condition to a printer's users. Partial ejection of a last sheet reduces the risk that a user unknowingly retrieves only a partially completed job if the paper were to run out in the middle of the print job. Further, replenishment of the paper is more likely to occur by physically restricting retrieval of the partially ejected sheet until the out of paper status is overcome. These and other advantages of the aspects of the present invention will be more fully understood in conjunction with the following detailed description and accompanying drawings.

DETAILED DESCRIPTION

The present invention relates to providing an out of paper indication by a printer. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown but is to be accorded the widest scope consistent with the principles and features described herein.

Figure 1:
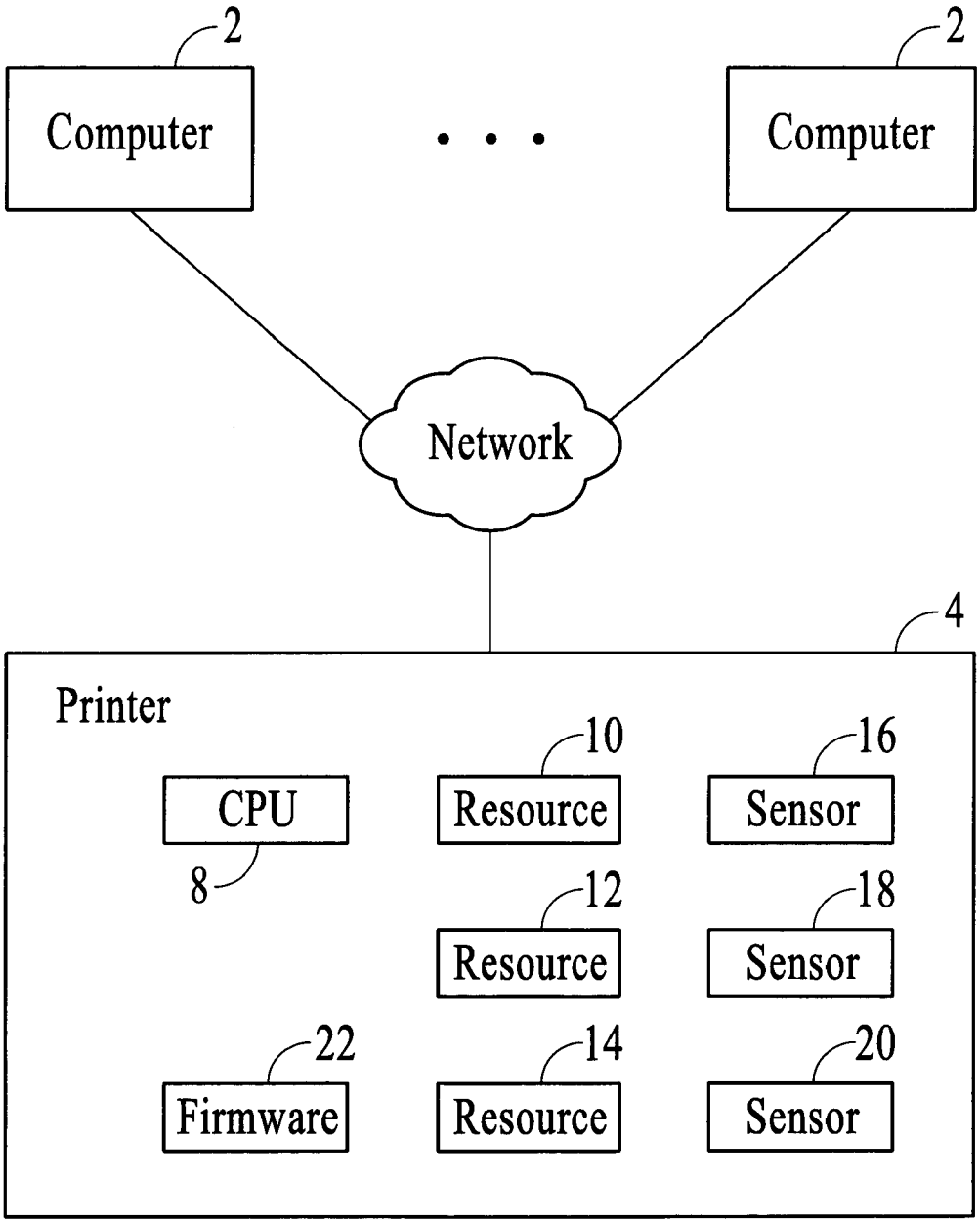
FIG. 1 illustrates a printer environment in which aspects of the invention are implemented.

FIG. 1 illustrates a printer environment in which aspects of the invention are implemented. A plurality of computers 2 are in communication with a printer 4 over a network 6. The computer(s) 2 may comprise any computing system known in the art, such as a personal computer, laptop, palm top, telephony device, desktop system, mainframe, etc. The network 6 may comprise any computer network known in the art, including a Local Area Network (LAN), Wide Area Network (WAN), Ethernet, the Internet, etc. The printer 4 may comprise any type of printer known in the art. The printer 4 includes a printer central processing unit (CPU) 8 and a plurality of consumable resources 10, 12, and 14. The resources may comprise any type of resource consumed by the printer 4, such as paper, toner, fuser oil, etc. For each of the resources 10, 12, and 14 there is a resource sensor 16, 18, and 20 that detects a level of the resource, particularly when the resource is approximately depleted. For paper resources, the resource sensor would comprise an electromechanical sensor that detects paper in the resource of an input paper tray.

Figure 2:
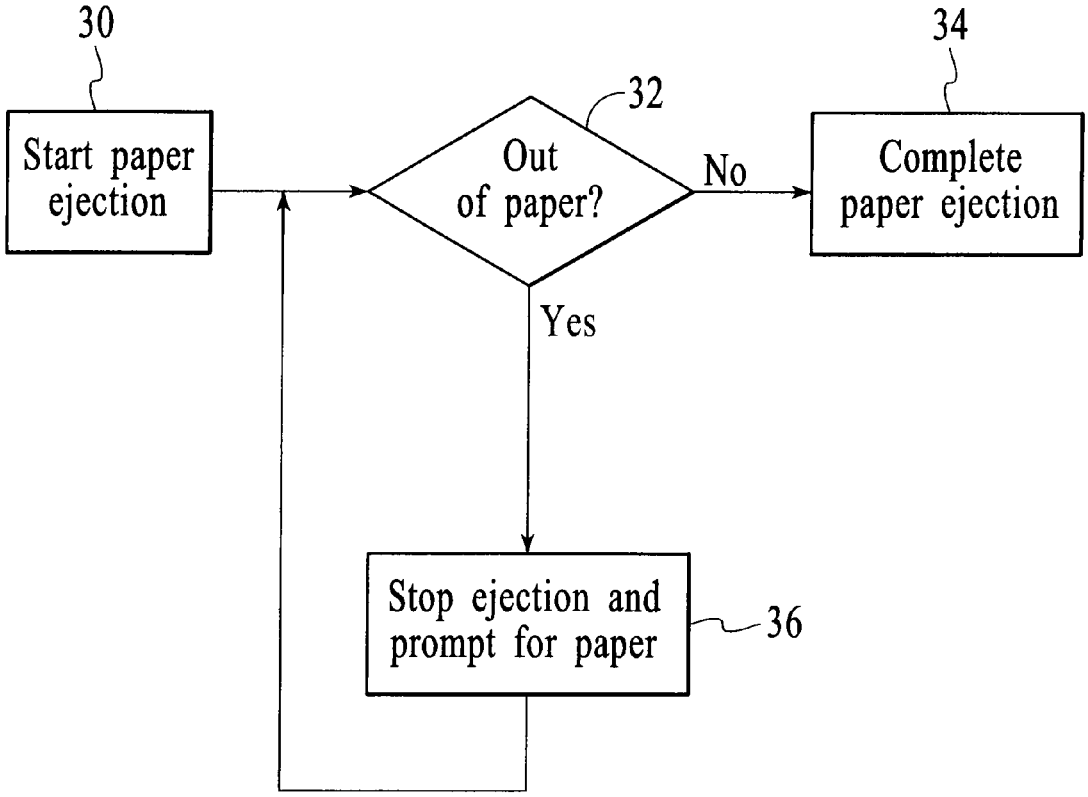
FIG. 2 illustrates a block flow diagram of a process for providing an out of paper indication by a printer in accordance with the present invention.

FIG. 2 illustrates a block flow diagram of a process for providing an out of paper indication by the printer 4 in accordance with the present invention. Preferably, the process is provided as program instructions of a suitable programming language and stored on a computer readable medium for performance by the printer CPU 8, i.e., is provided as part of a paper handler in printer firmware 22, as is well appreciated by those skilled in the art. The process begins by starting paper ejection of a page being printed (step 30). A check of the paper status follows (step 32) to determine whether the sheet of paper being ejected is the last sheet in the paper tray leading to an out of paper condition. When the paper being ejected is not the last sheet, the ejection of the paper completes (step 34). However, when the paper being ejected is the last sheet, the ejection is stopped so that the page is only partially ejected and a prompt for paper to be added is signaled, such as through a message on an LCD message screen of the printer (step 36). The partial ejection remains in effect until the paper supply is replenished.

In this manner, the partially ejected paper provides a more visible out of paper indicator to a printer's users. Further, the partial ejection encourages replenishment of the paper by physically restricting retrieval of the partially ejected sheet until the out of paper status is overcome. Additionally, the risk that the owner of that print job would take from the printer output tray only a partially completed job is substantially eliminated.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for providing an out of paper indication by a printer, the method comprising:

controlling paper ejection during a print job to provide an out of paper indication with a last sheet of a paper supply in a printer, wherein the controlling further comprises starting ejection of a page of the print job;

determining if the page being ejected comprises the last sheet; and stopping ejection of the page when the page does comprise the last sheet.

2. The method of claim 1 further comprising completing ejection of the page when the page does not comprise the last sheet.

3. The method of claim 1 further comprising maintaining partial ejection of the last sheet until paper is added to the paper supply.

4. The method of claim 1 further comprising performing the controlling in firmware of the printer.

5. A system for providing an out of paper indication by a printer, the system comprising:

a paper supply container;

a paper supply sensor; and a processor coupled to the paper supply sensor for monitoring the paper supply during a print job and controlling paper ejection during the print job to provide an out of paper indication with a last sheet of the paper from the paper supply container, wherein the processor further controls starting ejection of a page of the print job, wherein the processor determines if the page being ejected comprises the last sheet, wherein the processor controls completion of election of the page when the page does not comprise the last sheet, and wherein the processor controls stopping the ejection of the page when the page does comprise the last sheet.

6. The system of claim 5 wherein the processor controls completion of ejection of the page when the page does not comprise the last sheet.

7. The system of claim 5 wherein the processor controls maintaining partial ejection of the last sheet until paper is added to the paper supply.

8. A computer readable medium containing program instructions for providing an out of paper indication by a printer, the program instructions comprising:

controlling paper ejection during a print job to provide an out of paper indication with a last sheet of a paper supply in a printer, wherein the controlling further comprises starting ejection of a page of the print job;

determining if the page being ejected comprises the last sheet; and stopping ejection of the page when the page does comprise the last sheet.

9. The computer readable medium of claim 8 further comprising completing ejection of the page when the page does not comprise the last sheet.

10. The computer readable medium of claim 8 further comprising maintaining partial ejection of the last sheet until paper is added to the paper supply.

* * * * *